US007488043B2

(12) United States Patent
Boucherie

(10) Patent No.: US 7,488,043 B2
(45) Date of Patent: Feb. 10, 2009

(54) DEVICE FOR MANUFACTURING BRUSHES

(75) Inventor: Leonel Polydore Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 766 days.

(21) Appl. No.: 11/039,827

(22) Filed: Jan. 24, 2005

(65) Prior Publication Data

US 2005/0168050 A1 Aug. 4, 2005

(30) Foreign Application Priority Data

Feb. 4, 2004 (BE) ..... 2004/0057

(51) Int. Cl.
*A46D 1/00* (2006.01)

(52) U.S. Cl. ..... 300/11; 300/2; 300/10

(58) Field of Classification Search ..... 300/2, 300/10, 11, 21, 3; 198/346.2, 346.3, 465.4, 198/867.02, 867.14; 29/33 P, 26 A
See application file for complete search history.

(56) References Cited

U.S. PATENT DOCUMENTS

| | | | | |
|---|---|---|---|---|
| 3,858,941 | A | 1/1975 | Boucherie | |
| 6,409,438 | B1 * | 6/2002 | Kohler | 409/131 |

FOREIGN PATENT DOCUMENTS

| | | |
|---|---|---|
| EP | 0 284 125 | 9/1988 |
| GB | 1 592 688 | 7/1981 |

* cited by examiner

*Primary Examiner*—Laura C Guidotti
(74) *Attorney, Agent, or Firm*—Bacon & Thomas, PLLC

(57) ABSTRACT

Device for manufacturing brushes, which mainly consists of a number of tools along which is provided a transport means (7), onto which transport means (7) is fixed at least one brush holder (12), characterized in that the device (1) is provided with coupling means which make it possible to couple and uncouple the brush holder (12) concerned to and from the transport means (7), and in that, opposite to at least one tool, a drive (35) is provided to position and move the uncoupled brush holder (12) in relation to said tool (2-6), whereby this drive (35) is provided with locking means which make it possible to fix an uncoupled brush holder (12) to this drive (35).

18 Claims, 5 Drawing Sheets

DEVICE FOR MANUFACTURING BRUSHES

BACKGROUND OF THE INVENTION

1. Field of the Invention

The present invention concerns a device for manufacturing brushes, more particularly for providing fibers in a brush body.

2. Discussion of the Related Art

Such devices are already known which are mainly formed of a turret, upon which several brush holders are provided. Around the turret are provided several fixed tools, such as a drilling tool to drill holes which are designed to take up fiber bundles; a filling tool to provide fibers in the above-mentioned holes; a cutting tool to cut the provided fibers at the required length; and a loading an unloading tool for finished brush bodies and brush bodies to be finished.

By turning the known turret, the brush bodies which are clamped on the brush holders will be presented to the different tools.

In order to provide fibers in a brush body, a series of holes will have to be provided in that brush body, in which fibers can be fixed later on. As these holes, in some cases, have to be provided at different angles, the brush body must be able to turn in relation to the boring tool and in relation to the filling tool.

The turning of the brush bodies, with the known device, is obtained by providing every brush holder with a drive which makes it possible to present the brush bodies in a suitable manner in different positions to the boring tool and to the filling tool.

A disadvantage of the known devices is that each of the brush holders is equipped with a full drive to turn the brush bodies in relation to the boring tool and the filling tool, while these drives are unnecessary when cutting the fibers which have been inserted in the brush body or when loading and unloading the brush bodies on the turret.

A disadvantage coupled thereto is that the turret is relatively heavily loaded and, as a consequence, has to be driven with a relatively strong source of power to move the brush holders, at the required speed, between two successive tools.

Another disadvantage of providing every brush holder with its own drive, is that the device is relatively complex and, as a consequence, is relatively expensive and requires much maintenance.

Another disadvantage of the known device is that the brush holders are part of the turret, so that for manufacturing different types of brushes, also different types of adapted turrets are required, which is disadvantageous in that a brush manufacturer has to make relatively large investments, for every series of brushes of a different type he wishes to produce.

Finally, also the use of a turret has a major disadvantage, namely in that such a turret is positioned vertically in the known device, so that repair and maintenance of the different parts is difficult, as these parts, in most cases, are situated close to the ground or at the top of the turret, where they are difficult to access for maintenance operators.

SUMMARY OF THE INVENTION

The present invention aims to remedy one or several of the above-mentioned and other disadvantages.

To this end, the present invention consists of a device for manufacturing brushes, which mainly consists of a number of tools along which has been provided a transport means, onto which transport means has been fixed at least one brush holder, whereby the device is provided with coupling means which make it possible to couple the brush holder concerned and to uncouple it from the transport means, whereby, opposite to at least one tool, a drive is provided to position and move the uncoupled brush holder in relation to said tool, and whereby this drive is provided with locking means which make it possible to fix an uncoupled brush holder to this drive.

An advantage of this device according to the invention for manufacturing brushes, is that only a limited number of such drives are necessary, since such a drive can be used for different brush holders, as opposed to the known devices whereby every brush holder is provided with its own drive. As a result, the device can be made relatively cheap and, moreover, it requires less maintenance.

Another advantage of the present invention is that the drive for the brush holders is an independent element which is not suspended together with brush holders to the transport means, as a result of which the transport means is loaded less heavily than in the above-described and known devices, and as a result of which the device according to the present invention requires only a relatively small source of power to move the brush holders.

Another advantage is that the brush holders can be uncoupled from the transport means in a fast and simple manner, so that it becomes possible to fix other types of brush holders to the transport means, and as a result of which the device according to the invention can be adapted in a simple manner for manufacturing brushes of different types.

An advantage coupled thereto is that brush manufacturers can manufacture, with only a single device and a relatively small investment, a large number of different brushes.

In addition, it should be noted that, with a device according to the invention, different tools such as the transport means, the filling tool, the above-mentioned drive and the like can be made as a standard part, so that only a relatively small supply of spare parts is required and as a result of which these spare parts will be more easily on hand.

The above-mentioned transport means preferably consists of a chain situated in a horizontal or practically horizontal plane and situated at the height of a man, for example 160 cm above the ground surface.

An advantage of this preferred device is that all parts are relatively easily accessible, so that also maintenance and repairs can be carried out in a relatively fast and simple manner.

BRIEF DESCRIPTION OF THE DRAWINGS

In order to better explain the characteristics of the invention, the following preferred embodiments of a device according to the invention are described as an example only without being limitative in any way, with reference to the accompanying drawings, in which.

DESCRIPTION OF THE PREFERRED EMBODIMENT

Figure 1:
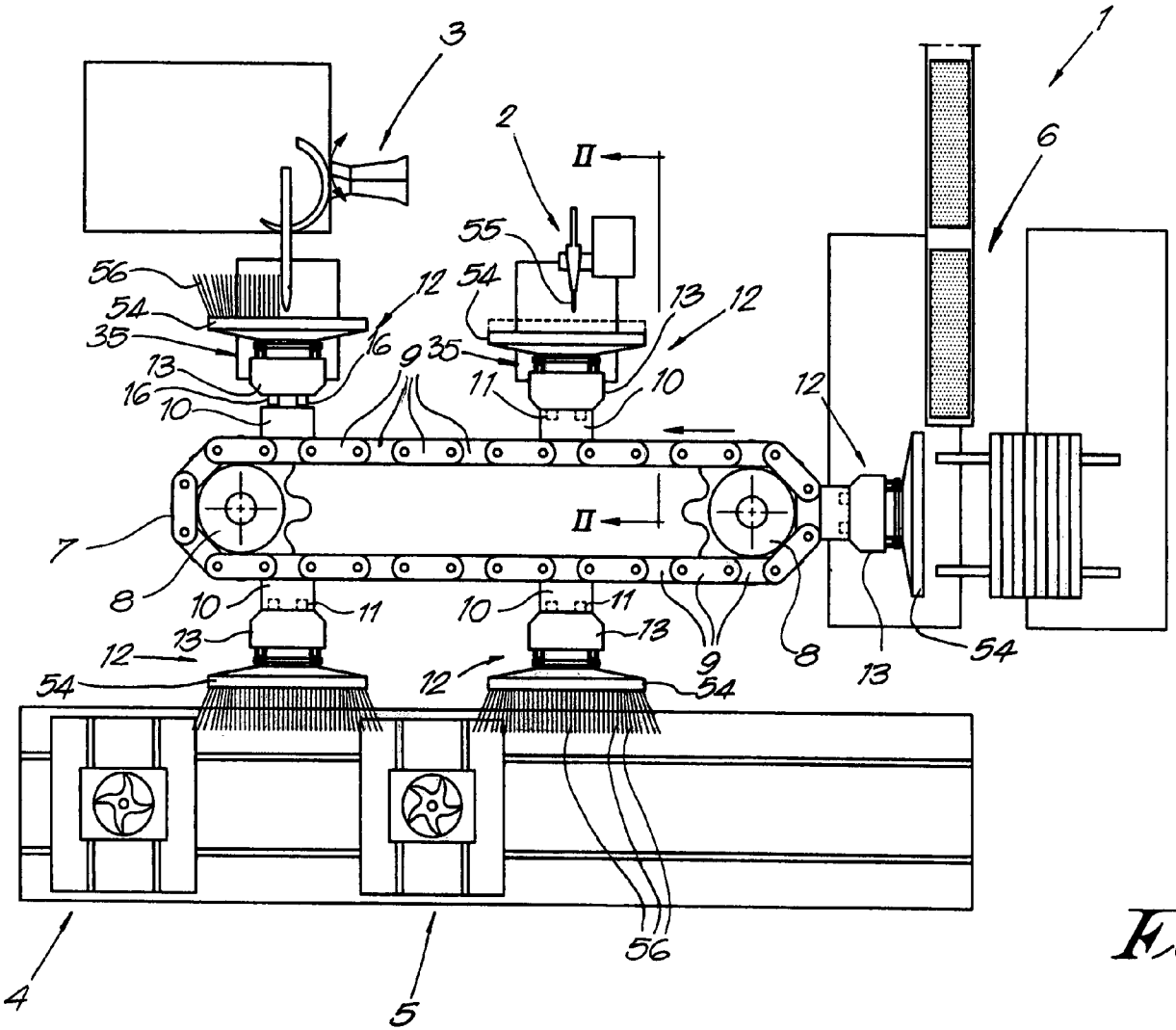
FIG. 1 is a schematic top view of a device according to the invention.

FIG. 1 represents a device 1 according to the invention which mainly consists of a number of tools, such as a boring tool 2, a filling tool 3, one or several cutting tools 4 and 5, a loading and unloading tool 6 and the like, alongside which is provided a transport means, in this case in the form of a chain 7.

In this case, the chain 7 is guided around two gear wheels 8, at least one of which is connected to a motor which is not represented in the figures.

Figure 2:
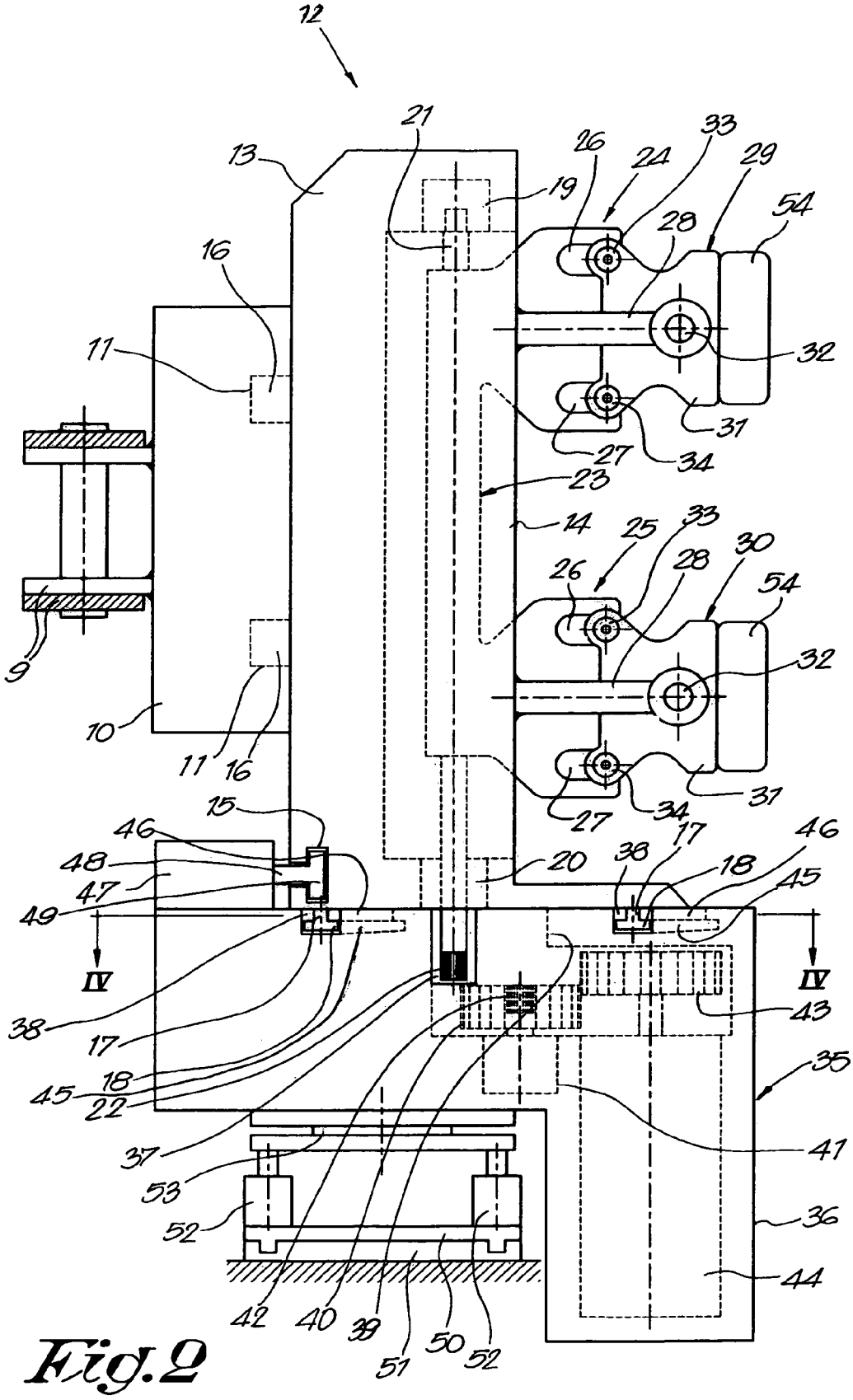
FIG. 2 represents the section according to line II-II in FIG. 1 to a larger scale.
Figure 3:
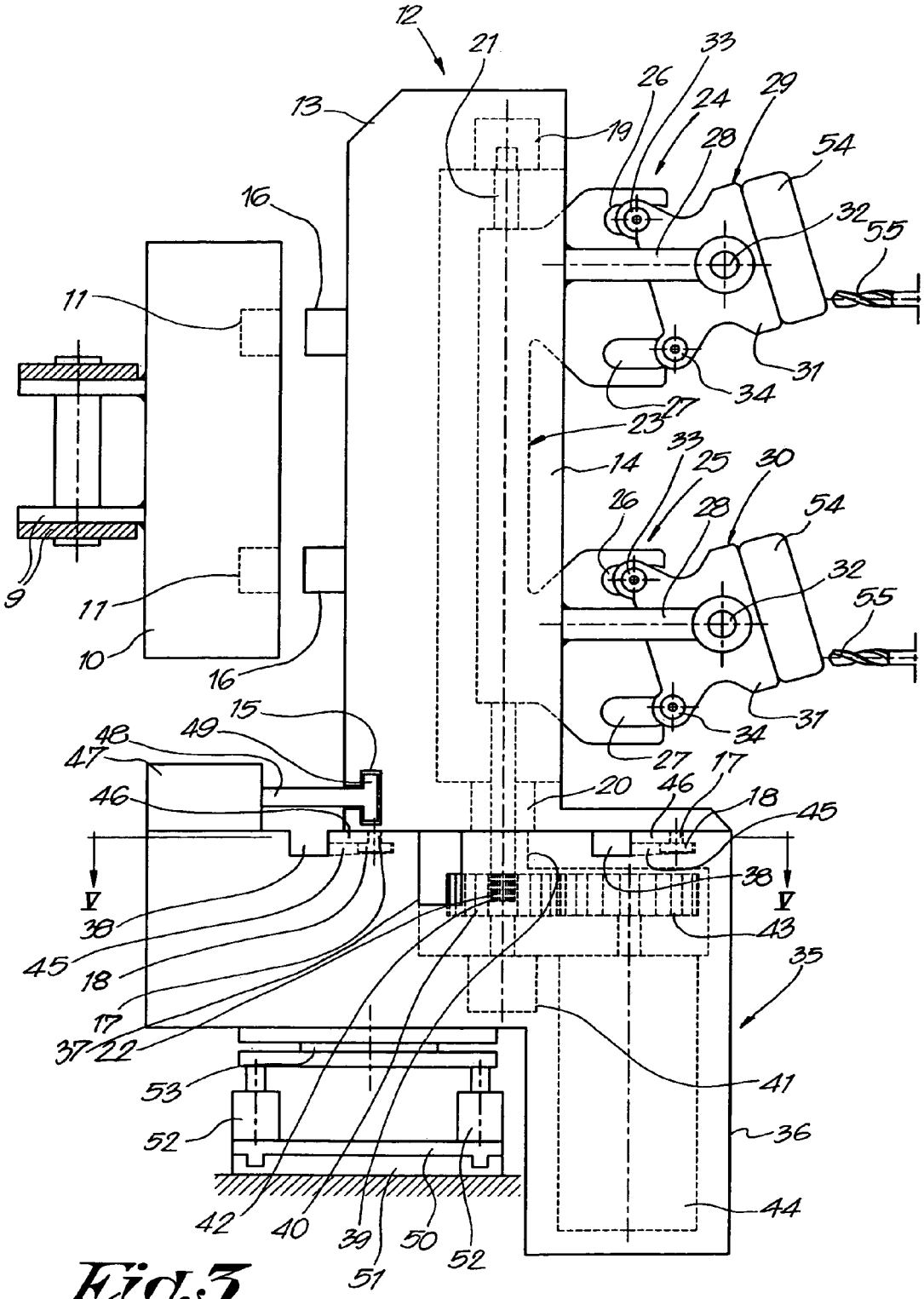
FIG. 3 represents a view identical to that in FIG. 2, but in another operating position.

As is represented in FIGS. 2 and 3, blocks 10 are fixed to different links 9 of the above-mentioned chain 7, for example by means of welding, whereby in each of these blocks 10, in the given embodiment, are provided different holes 11.

Onto each of the above-mentioned blocks 10 can be fixed a brush holder 12 which, in this case, each mainly consist of a housing 13 confining an open space 14 and in which, on the side opposite to the chain 7, is provided a groove 15, for example with a T-shaped section. On the above-mentioned side of the blocks 10 are also provided one or several outwardly directed dowel pins 16 which can work in conjunction with the above-mentioned holes 11 in order to couple the brush holders 12 to the chain 7. At the bottom of the housing 13 are provided locking elements which, in this case, consist of four pins 17, which are provided with a widened head 18 at their free ends.

In the above-mentioned space 14, extending over practically the entire height of the housing 13 to the bottom side of this housing 13, are each time provided a bearing bush 19 and 20 at the top and at the bottom, in which a threaded rod 21 is bearing-mounted, provided with a coupling part on one far end, for example in the shape of an axially directed toothing 22 or the like, and whereby the toothing 22 protrudes under the above-mentioned housing 13.

The brush holder 12 further contains a carriage 23 having a passage, which is not visible in the accompanying FIGS. 1 to 6, and which is at least partly made in the shape of a threaded hole, through which the above-mentioned threaded rod 21 has been provided, such that the carriage 23 is situated between the above-mentioned bearing bushes 19 and 20 in the space 14 inside the housing 13.

The carriage 23 in this case comprises two crosswise protruding parts 24 and 25, which are each, at their free ends, provided with two grooves 26 and 27.

Every brush holder 12 is provided, on its side opposite to the tools, with two pairs of laterally protruding rods 28, whereby between each pair of rods 28 has each time been provided a seat 29-30 in the shape of two parallel plates 31, which are fixed tightly on a shaft 32, which shaft 32 has been suspended in a rotating manner between the rods 28 concerned, more particularly such that it can tilt between two extreme angular positions.

The above-mentioned plates 31 of each seat 29-30 are provided with guide rollers 33 and 34 which are each held in the grooves 26 or 27 of the above-mentioned carriage 23.

Opposite to each of the above-mentioned tools, more particularly opposite to the boring tool 3 and opposite to the filling tool 4, has each time been provided a drive 35 according to the invention, for the above-described brush holders 12.

Figure 4:
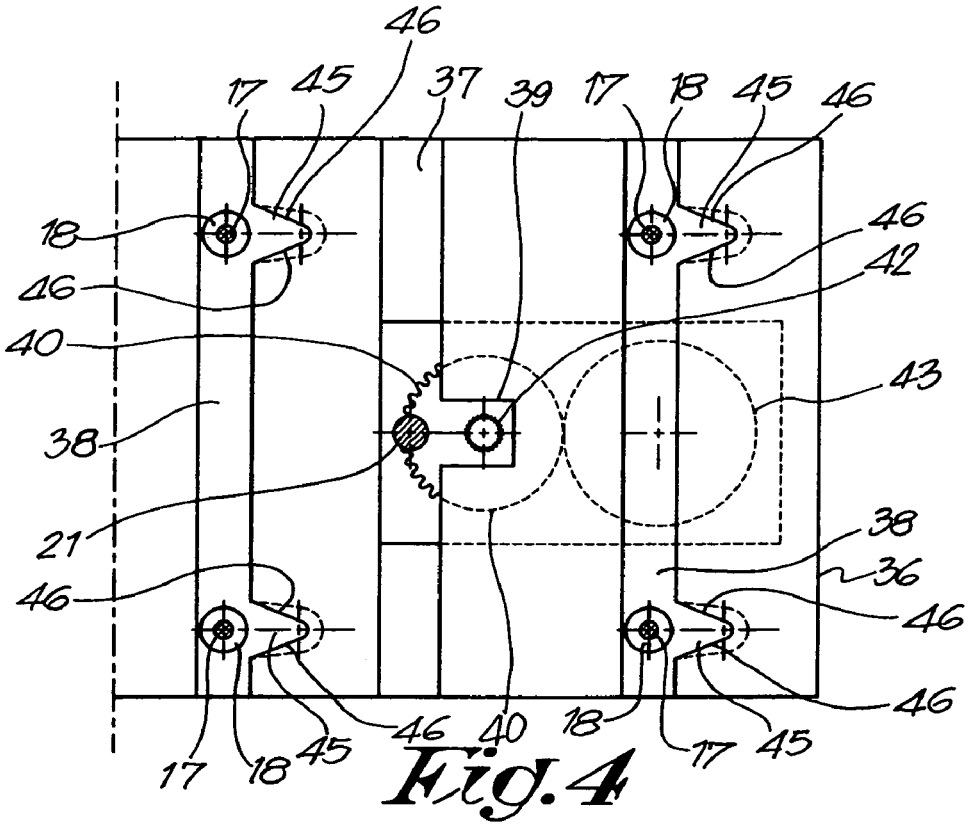
FIG. 4 represents a section according to line IV-IV in FIG. 2.
Figure 5:
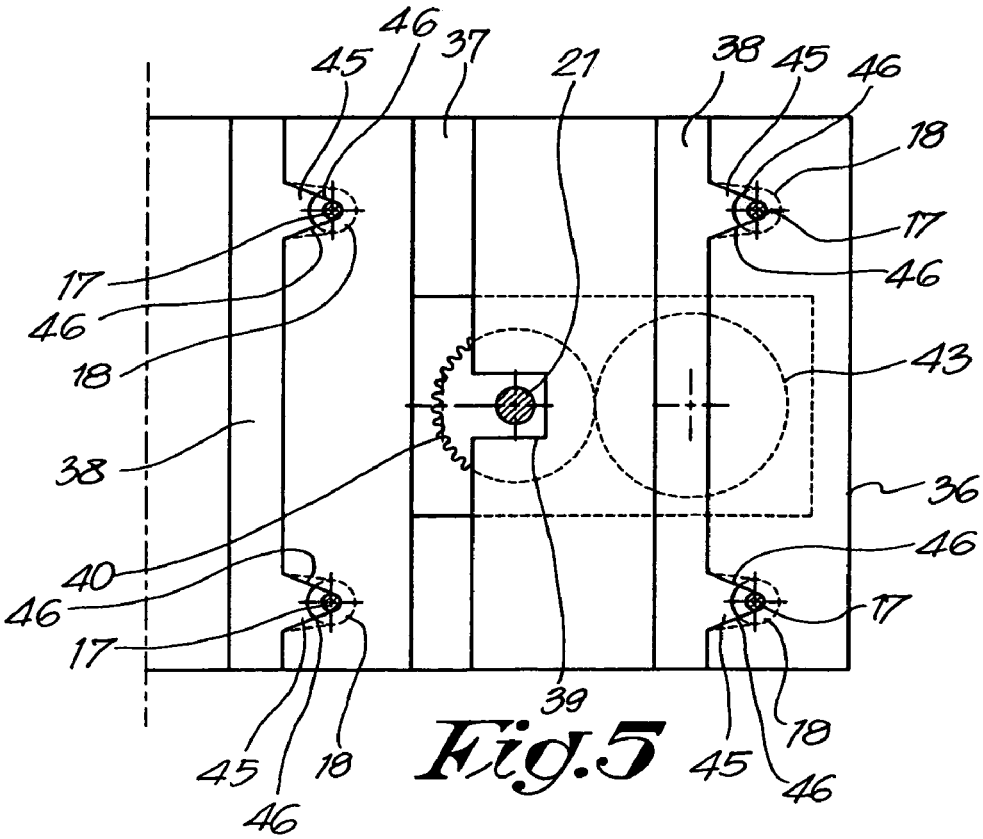
FIG. 5 is a section according to line V-V in FIG. 3.

As is represented in FIGS. 4 and 5, such a drive 35 consists of a housing 36, in which have been provided, on the top side, one central groove 37 and two lateral grooves 38 which all extend over the entire width of the drive 35 and which run parallel to each other in a direction following the direction of transport of the chain 7.

The central groove 37 has a widening 39, more or less centrally in relation to the top side of the housing 36, under which has been provided a mobile gear wheel 40, for example on a cylinder 41.

This gear wheel 40 has a central coupling part, for example in the shape of an inner toothing 42 or the like, situated immediately under the widening 39 in the above-mentioned groove 37.

Next to and opposite to the above-mentioned gear wheel 40 is situated a second gear wheel 43 which is provided with a drive element 44, schematically represented by means of a dashed line.

In the upper wall of the housing 36 are provided recesses 45, crosswise as of each of the above-mentioned grooves 38, which extend in one and the same direction as the widening 39 in the above-mentioned central groove 37, which recesses 45 are provided with an inwardly protruding edge 46 which in this case is pointed.

The above-mentioned drive 35 with gear wheels 40 and 43 forms, together with the above-mentioned threaded rod 21 and the carriage 23 which has been fixed on the latter, a drive means for the seats 29-30 of said brush holder 12, whereby the above-mentioned threaded rod 21 and carriage 23 form what is called a transmission part of said drive means.

On top of the housing 35, under, or practically under the chain 7, has been fixed a cylinder 41, whose piston rod 48 can extend in a direction crosswise to the direction of transport of the chain 7.

The above-mentioned piston rod 48 is preferably provided on its free end with a crosswise plate 49, which can be guided in the above-mentioned T-shaped groove 15 of the brush holder 12.

This cylinder 47 forms in this case, together with the T-shaped groove 15, the dowel pins 16 at the back of the brush holders 12 and the co-operating holes 11 in the blocks 10 which are fixed to the chain 7, so-called coupling means which make it possible to couple the brush holders 12 to and to uncouple them from the chain 7. This coupling is preferably reinforced as electromagnets are integrated in the blocks 10 which draw the brush holders 12 against the blocks 10 when they are excited.

The drive 35 is further provided with shifting means which consist of a carriage 50, provided in a shifting manner on a guide 51 which extends in a direction crosswise to the working direction of the tool concerned. On the carriage 50 are provided preferably upward directed cylinders 52 or the like which support a revolving element 53, upon which the above-mentioned housing 36 of the drive 35 is fixed and whereby every movement is provided with appropriate drive elements in the form of servomotors, which are controlled via a control box in which computers or the like are provided.

The above-mentioned shifting means and/or the above-mentioned drive means provide the drive 35 with a number of degrees of freedom for moving the brush holders 12 and/or the seats 29-30 in relation to the tool 2-3 concerned. In the described embodiment, five degrees of freedom are provided to this end, more particularly three degrees of freedom for the linear movement of the seats 29-30 in relation to the tool 2-3 concerned, according to three preferably orthogonal axes, and two degrees of freedom for the rotation of the seats 29-30 around two of the above-mentioned axes.

Naturally, also the rotation around the remaining axis can be provided for, so that the number of degrees of freedom for positioning the seats 29-30 amounts to six.

It should be noted that, in the above-described device 1, the different tools comprise, as is known, two functional units which make it possible to simultaneously tool two brush bodies 54.

In the case of the boring tool 2, this means that there are two drill heads which each drive a bore 55, whereby both drill heads are connected to each other in a fixed manner at a mutual distance which is equal to the mutual distance between the above-mentioned seats 29 and 30.

The working of the device 1 according to the invention for manufacturing brushes is relatively simple and as follows.

The brush holders 12 are in the first place loaded by the loading and unloading tool 6 which, in this case, applies two brush bodies 54 to the seats 29 and 30 of the brush holder 11 concerned.

Next, the chain 7 revolves until the loaded brush holder 12 is situated opposite to the boring tool 2, whereby the cross plate 49 on the piston rod 48 of the cylinder 47 in the T-shaped groove 15 is guided behind the housing 13 of the brush holder 12, whereby the widened heads 18 of the pins 17 at the bottom of the above-mentioned brush holder 12 slide in the grooves 38 of the drive 35; and whereby the far end of the above-mentioned threaded rod 21, which is provided with a toothing 22, moves into the central groove 37 of the drive 35.

When the brush holder 12, which is coupled to the chain 7, is situated right opposite to the drive 35 concerned, the above-mentioned coupling means are activated, whereby the piston rod 48 is pushed from the cylinder 47 among others.

By pushing out this cylinder 47, the brush holder 12 is detached from the chain 7, more particularly from the block 10 concerned which is fixed to the chain 7, and the brush holder 12 is fixed to the drive 35 positioned opposite to the boring tool 2, namely as the pins 17 at the bottom of the brush holder 12 are provided in the recesses 45, in the side wall of the grooves 38, in the housing 36 of the drive 35, whereby the heads 18 of the pins 17 mesh under the inwardly directed edge 46 of the above-mentioned recesses 45 and lock the brush holder 12 in relation to the drive 35.

The piston rod 48 of the cylinder 47 being pushed out also has for a result that the threaded rod 21 is positioned co-axial to the toothing 39 of the mobile gear wheel 40, after which this gear wheel 40 is moved up with the help of the cylinder 41 provided to that end, until the axial toothing 22 of the above-mentioned threaded rod 21 is led in the inner toothing 42, and the threaded rod 21 can be driven by a rotation of the gear wheels 40 and 43 of the drive 35.

The boring of the holes is carried out, as is known, by moving the boring tool 2 axially to and fro in relation to the brush body 54 concerned.

In order to change the drilling direction in relation to the brush body 54, the brush holder 12 can be rotated around a vertical shaft, by means of the rotatable shaft 49 which can make the drive 35 rotate.

A rotation of the brush bodies 54 around a horizontal shaft is possible by driving the so-called second gear wheel 43, which in turn drives the first gear wheel 40, such that the threaded rod 21 rotates around its longitudinal axis.

Thanks to this rotation of the threaded rod 21, the carriage 23, and consequently also the protruding parts 24 and 25 of this carriage 23 are moved up or down, such that the seats 29 and 30, which are fixed to the housing 13 of the brush holder 12 concerned on the one hand, and which are held with their guide rollers 33 and 34 in the grooves 26 and 27 in the above-mentioned protruding parts 24 and 25 on the other hand, are forced to rotate around their central axis 32.

After the required holes have been bored in the brush bodies 54, the mobile gear wheel 40 is moved down again by means of the cylinder 41, after which the brush holder 12 is coupled to the chain 7 again by bringing the cylinder 47 behind the brush holder 12 in a withdrawn position, after which the brush holder 12 is locked to the block 10, for example by exciting the above-mentioned electromagnets.

The pins 17 and the far ends of the threaded rod 21 are hereby withdrawn from the recesses 45, the widening 39 respectively, into the grooves 38 and 37, such that when the brush holder 12 is moved further, it can slide out of the grooves 37 and 38 without hindrance.

When the brush holder 12 is moved further, also the plate 49 on the piston rod 48 of the cylinder 47 will slide out of the T-shaped groove 15 concerned, such that the brush holder 12 is smoothly removed from the drive 35.

Next, the chain 7 will move the brush holder 12 further into a position opposite to the filling tool 4, where the brush holder 12 is uncoupled again from the chain 7 and is connected to the drive 35 which is present here.

After the provided holes have been filled with fibers 56, in the brush body 54 concerned, the brush holder 12 concerned is removed from the drive 35 again and coupled to the chain 7.

The chain 7 then moves the brush holder 12 further to opposite each of the following tools, without the brush holder 12 being uncoupled any further.

It should be noted that the filling of the holes in the different brush bodies which are fixed to one and the same brush holder 12 can take place in different steps, whereby in each step, the holes in one of the brush bodies are filled by a simple filling tool 3, more particularly a filling tool 3 which has only one filling head. This is especially useful when the above-mentioned holes have to be filled with fibers 56 which are longer than the mutual distance between the seats 29-30 of the brush holder 12, as in this case, simultaneously providing the fibers 56 in different brush bodies 54 is made difficult as the fibers 56 for the different brush bodies 54 may hinder each other.

In this case, it is indicated to provide several of such filling tools along the transport means.

When the brush holder 12 reaches its starting position again, more particularly opposite to the loading and unloading tool 6, the brush bodies 54 which have just been finished are removed from the seats 29 and 30 concerned and they are carried off, after which the above-described cycle starts again.

As is represented in FIG. 1, the device 1 preferably comprises different brush holders 12, more particularly just as many brush holders 12 as the number of tools along which the chain 7 is guided.

It should be noted that not necessarily the same tools as in the above-described device 1 have to be provided. Thus, it is also possible to lead the chain 7 along additional tools, for example a tool for rounding off the fibers 56, or to remove a tool, for example the boring tool, in case brush bodies 54 made of plastic are taken as a basis, which have been provided with holes for fiber bundles beforehand.

Figure 6:
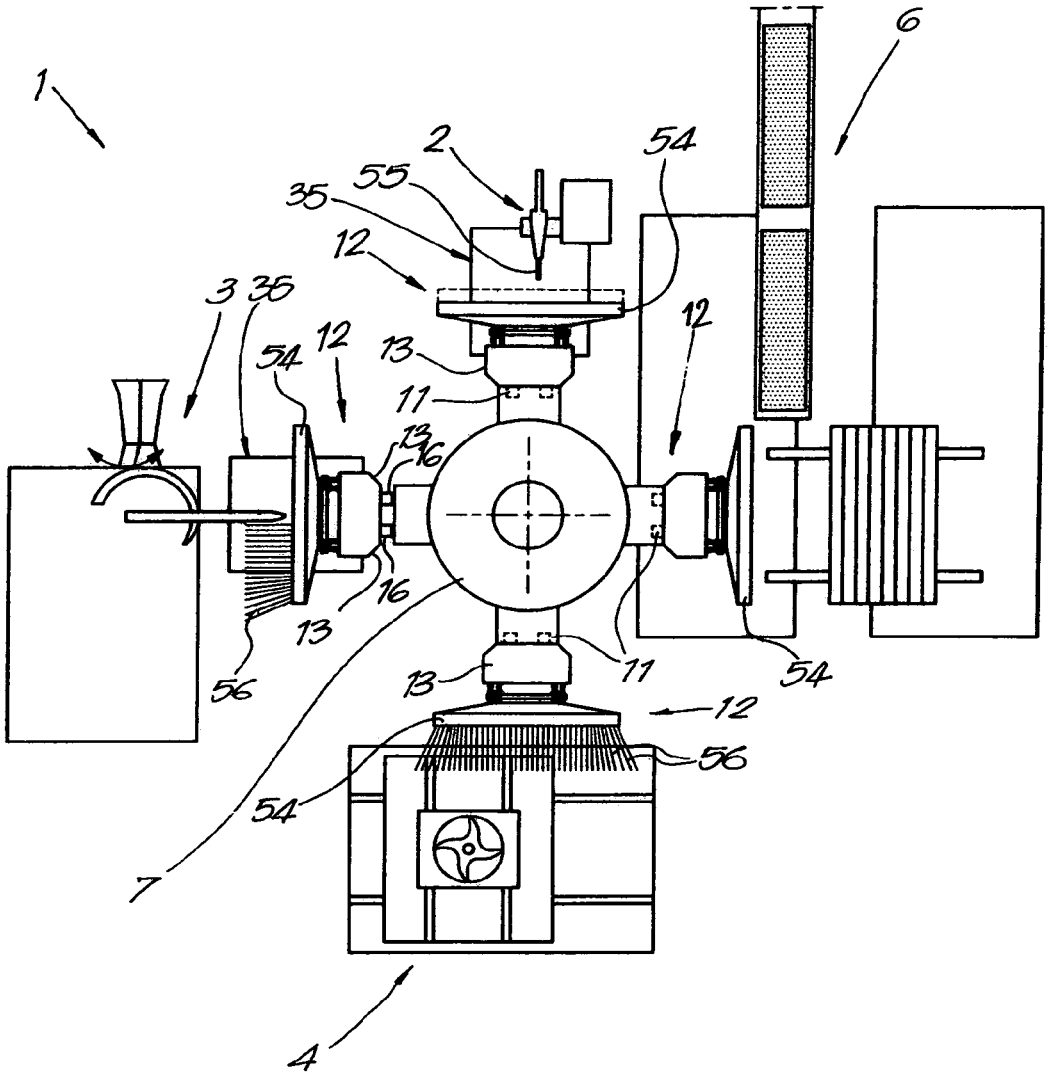
FIG. 6 schematically represents a variant of a device according to the invention.

As is represented in FIG. 6, it is also possible to use a turret 2 as transport means.

Further, it should be noted that the different means mentioned in the preceding description can be embodied in all sorts of known manners. Thus, for example, the above-mentioned coupling means which make it possible to uncouple each of the brush holders 12 from the chain 7 and then couple them again, can also be realized in the shape of a hook, for example, which is fixed to each of the brush holders 12 and which can work in conjunction with a recess in the blocks 10 concerned provided on the chain 7.

In that case, uncoupling the brush holders 12 from the chain 7 will require an additional operation from the shifting means, more particularly from the cylinders 52, which can move the brush holder 12 up in order to lift the above-mentioned hook from the recess concerned in the block 10.

Also the tilting of the seats 29 and 30 can be done in an alternative manner, for example by providing the drive 35 with an additional revolving element which extends in a horizontal, or practically horizontal direction, crosswise to the working direction. In the latter case, the use of the above-mentioned threaded rod 21 and of the carriage 23 becomes unnecessary.

The movements of two brush holders 12 are preferably synchronized when they are situated on the drives 35 opposite to the boring tool 2 and opposite to the filling tool 3, thus making sure that the filling tool 3 and the boring tool 2 always act on the same place and at the same angle onto the brush bodies 54.

It should be noted that it is also possible to provide the seats on the brush holder 12 concerned such that they can rotate at an angle of 360°, which is applied for example when manufacturing what are called toilet brushes.

Such a coupling can be realized, as is known, by providing both drives 35 concerned with what is called a servo-assisted control or by mechanically coupling the movements of both drives 35.

The present invention is by no means limited to the embodiments described as an example and represented in the accompanying drawings; on the contrary, such devices according to the invention for manufacturing brushes can be made in different shapes and dimensions while still remaining within the scope of the invention.

The invention claim is:

1. A device for manufacturing brushes, comprising a number of spaced apart brush making tools between and along which is provided a transport device, and onto which transport device is provided at least one brush holder, said transport device including coupling devices enabling coupling and uncoupling respective brush holders to and from the transport device, and opposite at least one tool, a drive arranged to position and move an uncoupled brush holder relative to said tool, said drive including a drive locking device enabling fixing an uncoupled brush holder to the drive, wherein each of the brush holders comprises a housing onto which is fixed at least one seat, wherein said at least one seat is configured to move relative to the respective brush holder, wherein said at least one seat is provided with a drive system for moving the at least one seat; and a control box, wherein the drive system includes different servomotors all controlled from the control box.

2. The device according to claim 1, wherein the transport device comprises a chain.

3. The device according to claim 2, wherein the transport device is oriented in a horizontal or practically horizontal plane.

4. The device according to claim 1, wherein the transport device comprises a turret.

5. The device according to claim 4, wherein the transport device is oriented in a horizontal or practically horizontal plane.

6. The device according to claim 1, wherein said at least one seat is disposed on the respective brush holder in a rotating manner.

7. The device according to claim 1, wherein said at least one seat is provided on the respective brush holder in a tilting manner, and arranged to be oriented between two extreme angular positions.

8. The device according to claim 1, wherein said drive system comprises a transmission part integrated in the respective brush holder between a drive source and the movable seat.

9. The device according to claim 8, wherein the transmission part comprises a carriage disposed in a shifting manner in the brush holder for moving the at least one seat.

10. The device according to claim 9, wherein the carriage is provided with a threaded hole through which extends a threaded rod which is bearing-mounted in said housing such that it can turn, and said rod is provided with a coupling part on one far end, said far end protruding beneath the housing of the brush holder.

11. The device according to claim 1, wherein said coupling device and locking device are driven by the drive.

12. The device according to claim 1, wherein said coupling device and locking device are driven by an external cylinder.

13. The device according to claim 1, wherein said drive is provided with a shifting device enabling movement of each respective brush holder relative to a respective tool.

14. The device according to claim 13, wherein the shifting device enables movement of each respective brush holder according to at least two degrees of freedom.

15. The device according to claim 14, including a separate servomotor for each movement of said brush holder according to each degree of freedom of movement.

16. The device according to claim 13, wherein the shifting device enables movement of each respective brush holder according to five degrees of freedom.

17. The device according to claim 16, wherein the drive for each movement according to any one of the degrees of freedom comprises a separate servomotor.

18. The device according to claim 1, wherein a first tool of said spaced apart tools includes a drilling tool having two drilling heads and wherein a second tool of said spaced apart tools is provided with a simple filling tool.

* * * * *